US007367859B2

(12) United States Patent
Richardi

(10) Patent No.: US 7,367,859 B2
(45) Date of Patent: May 6, 2008

(54) BEACH BUOY

(76) Inventor: Thomas H. Richardi, 795 Krocks Ct., Allentown, PA (US) 18106

( * ) Notice: Subject to any disclaimer, the term of this patent is extended or adjusted under 35 U.S.C. 154(b) by 0 days.

(21) Appl. No.: 11/602,036

(22) Filed: Nov. 21, 2006

(65) Prior Publication Data

US 2007/0128958 A1 Jun. 7, 2007

(51) Int. Cl.
*B63B 22/16* (2006.01)

(52) U.S. Cl. ..... 441/6; 52/4; 135/118; 248/146

(58) Field of Classification Search ..... 441/1, 441/6, 129, 130, 133, 136; 206/427; 220/560; 248/146, 311.2; 52/4, 5, 155, 162, 163, 166; 116/209, 210; 135/118, 119
See application file for complete search history.

(56) References Cited

U.S. PATENT DOCUMENTS

| | | | | |
|---|---|---|---|---|
| 2,840,092 | A * | 6/1958 | Hill | 135/118 |
| 5,176,354 | A | 1/1993 | Feigenbaum | |
| 5,294,083 | A * | 3/1994 | Roth | 248/146 |
| D366,660 | S | 1/1996 | Benson | |
| D369,527 | S | 5/1996 | Tesoriero | |
| 5,516,316 | A | 5/1996 | Rumminger | |
| 5,713,546 | A | 2/1998 | Auspos | |
| 5,769,677 | A | 6/1998 | Bell | |
| D396,383 | S | 7/1998 | Hanson | |
| 5,832,672 | A | 11/1998 | Griffiths | |
| 6,527,605 | B1 | 3/2003 | Charte | |
| 6,575,417 | B1 * | 6/2003 | Krommenakker | 248/311.2 |
| 6,631,527 | B2 * | 10/2003 | Hyduk | 5/417 |
| 6,991,505 | B1 * | 1/2006 | Wells | 441/136 |
| 2003/0077958 | A1 * | 4/2003 | Powell et al. | 441/1 |

* cited by examiner

*Primary Examiner*—Lars A. Olson

(57) ABSTRACT

A multiple use device constructed of either closed or open cell insulated foam ball with a wood or plastic steak molded into such ball for the purpose of inserting in sand or soil which will be utilized in the beach and boating recreational environments allowing the user to be able to secure there beach blanket to the device by a spring loaded clip and thus prevent such blanket or attached article(magazine, newspaper, etc) from blowing away by prevailing winds. The second objective is to allow the user to insert there beverage into a cylindrical opening at the top of such foam ball for the purpose of insulating such beverage from ambient temperatures. The cylindrical opening has sufficient length and rigidity to hold a fishing pole when surf casting at the ocean or any body of water were the unit can be inserted in soft ground. The foam ball buoy as a floatation device has multiple uses in the boating and fishing category were such unit can be used for an line, net or trap marker. The device will be used for advertising purposes with large beverage manufacturers or any such manufacturer who wishes to have there logo or name imprinted on the foam.

8 Claims, 4 Drawing Sheets

BEACH BUOY

FIELD OF THE INVENTION

The device relates to devices used for anchoring a beach blanket or any other item to the ground as not to be blown away by wind gusts. The device relates to the insulation of beverages by a insulated foam shape. The device relates to floating buoys for marking in large bodies of water.

This product is designed to provide a variety of uses for the beach going vacationer and those involved in boating and fishing for recreation. The invention is designed to perform multiple functions and surpasses other prior art which was limited in use to only holding a beverage and anchoring a beach blanket. The invention will be able to simultaneously keep a persons beach blanket and belongings from blowing away and at the same time insulate a beverage they insert in the buoy section of the product. Further more the device can be used to aid surf fisherman by holding there fishing pole or be used as a marker buoy for a variety of fishing and boating purposes.

SUMMARY OF THE INVENTION

The object of the invention is the integration of many technologies to form a multiuse consumer product. The invention or beach buoy will provide a convenient way for beach-goers to maintain a more pleasant beach experience. The insulated buoy will hold a standard size beverage can or bottle which will insulate the product from ambient air. Another objective of the unit is to secure the beach-goers blanket or miscellaneous papers, magazines etc. from blowing away by the use of a removable and adjustable spring loaded clip.

A third objective for the product is to aid surf fisherman or shoreline fisherman by being able to insert there fishing poles into the buoy section of the unit and hold the fishing pole in a vertical position. This allows the sport fisherman to rest from holding the pole or perform other activities. This integration of land uses exceeds what has been reviewed in prior art.

The additional advantage of the beach buoy over prior art is the fact that it has many uses as a buoy device. The product can be used for marking anchor lines for boats, crab or fish trap marker, or any other marker type application.

A forth objective of the beach buoy device is to be used as a novelty promotional item for large manufacturers of sodas, beer, or any other product where a manufacturer or business may want to advertise on the foam buoy body. This again expands the opportunity of the product compared to prior art.

OBJECTS OF INVENTION

Insulated beverage holder or small item holder (cell phones, keys, etc.)at beach
Floating Insulated beverage holder with attachment clip (pools, lakes, calm waters)
Beach blanket holder against wind gusts using adjustable height clip
Newspaper, magazine holder using adjustable height clip
Fishing pole holder
Fish line marker
Fishing location marker
Deep water warning buoy for swimming pools
Boat anchor line buoy for safety

DETAILED SPECIFICATION AND DESCRIPTION

Figure 1:
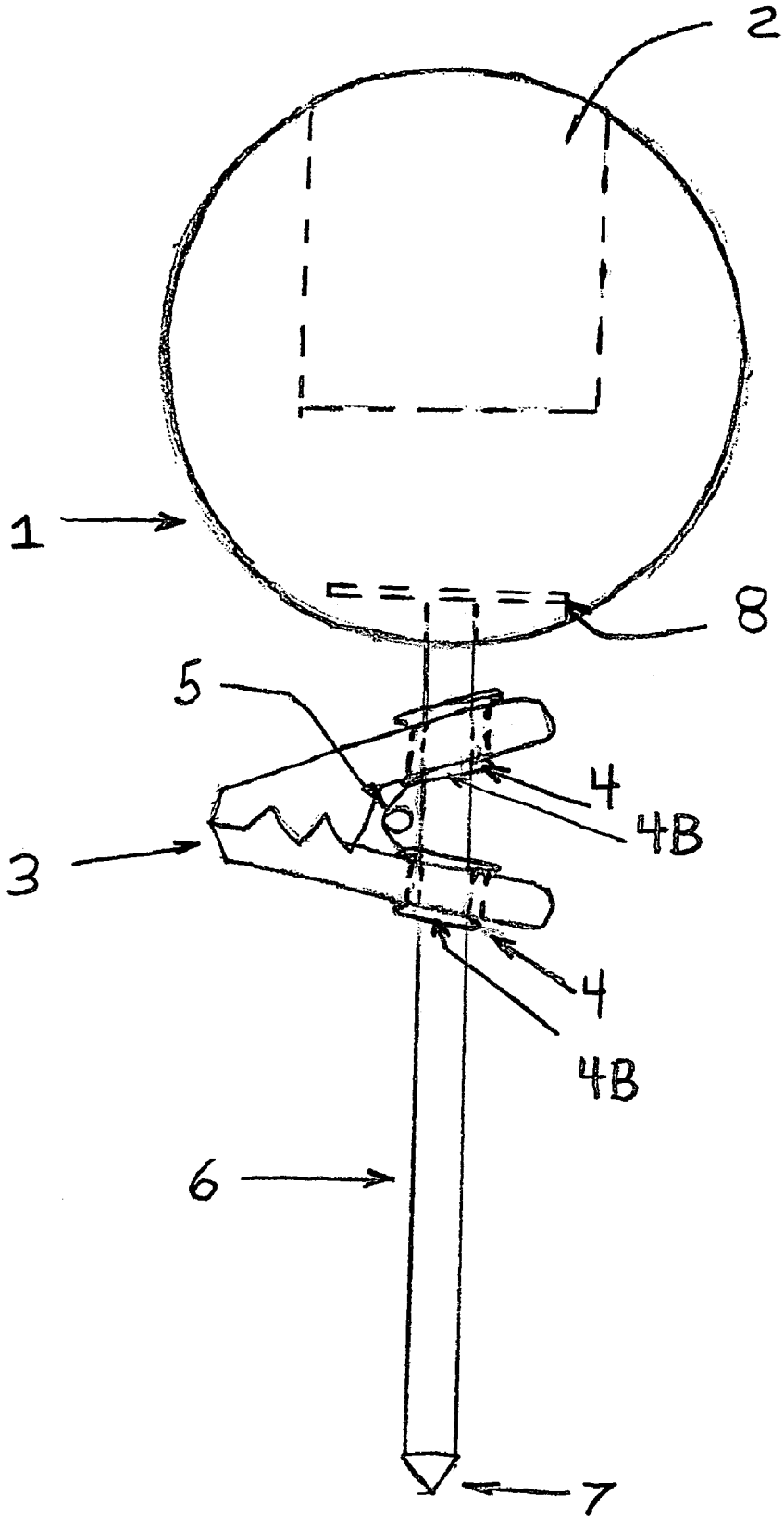
FIG. 1 is a side view of the unit showing the foam ball, molded in stake with support and clip installed.
Figure 4:
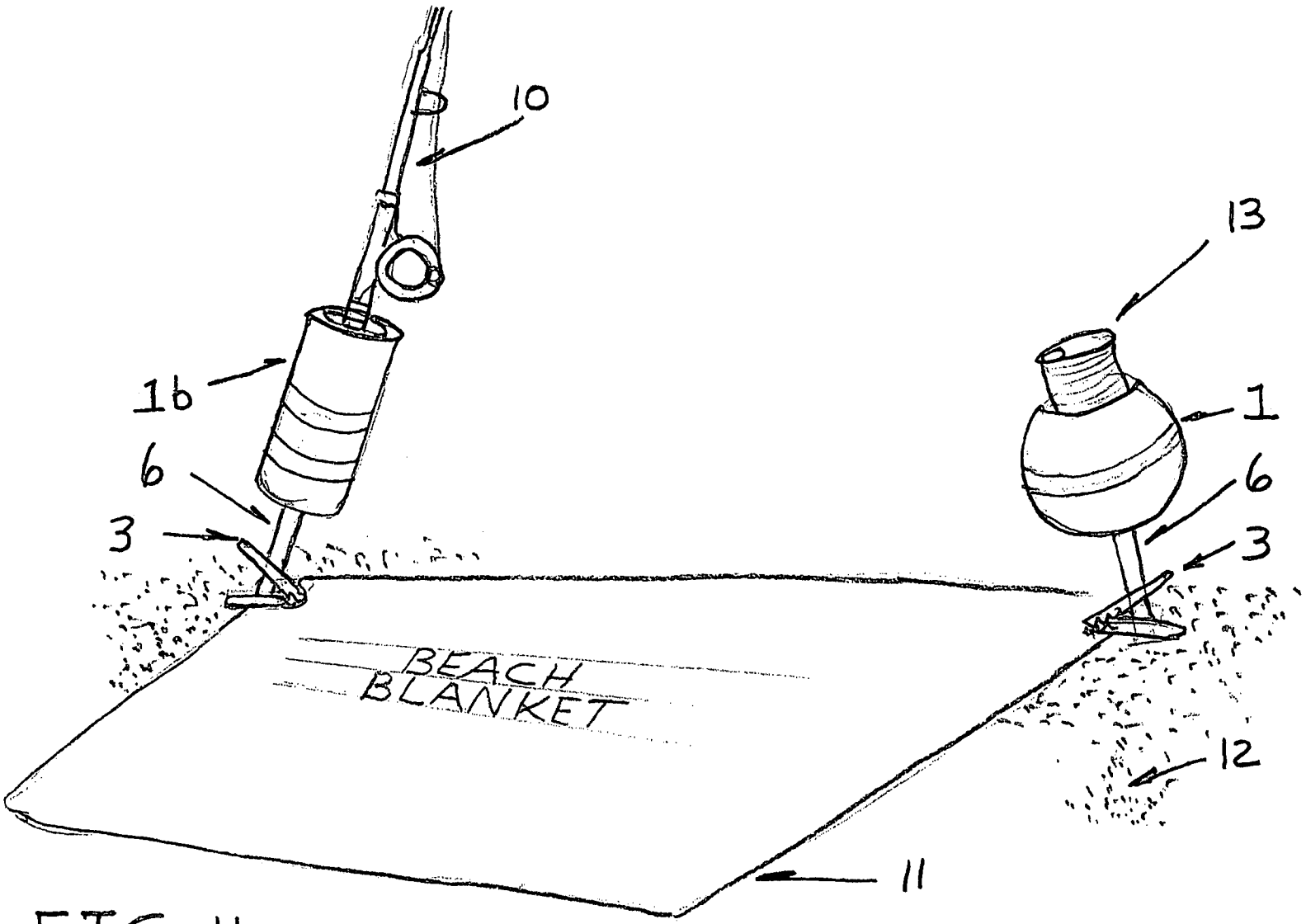
FIG. 4 is a isometric view of the invention showing both body design options in use as beach blanket and fish pole holder

As shown in FIG. 1 the invention is made from a 6 inch or larger diameter closed or open cell foam ball 1 which has been custom designed with a core hollowed out 2 to fit a aluminum can or glass bottle as shown in FIG. 4. 13 in the center of the ball 1 approximately three quarters of the length of the can to insulate the liquid in the can from the ambient air temperature.

Figure 2:
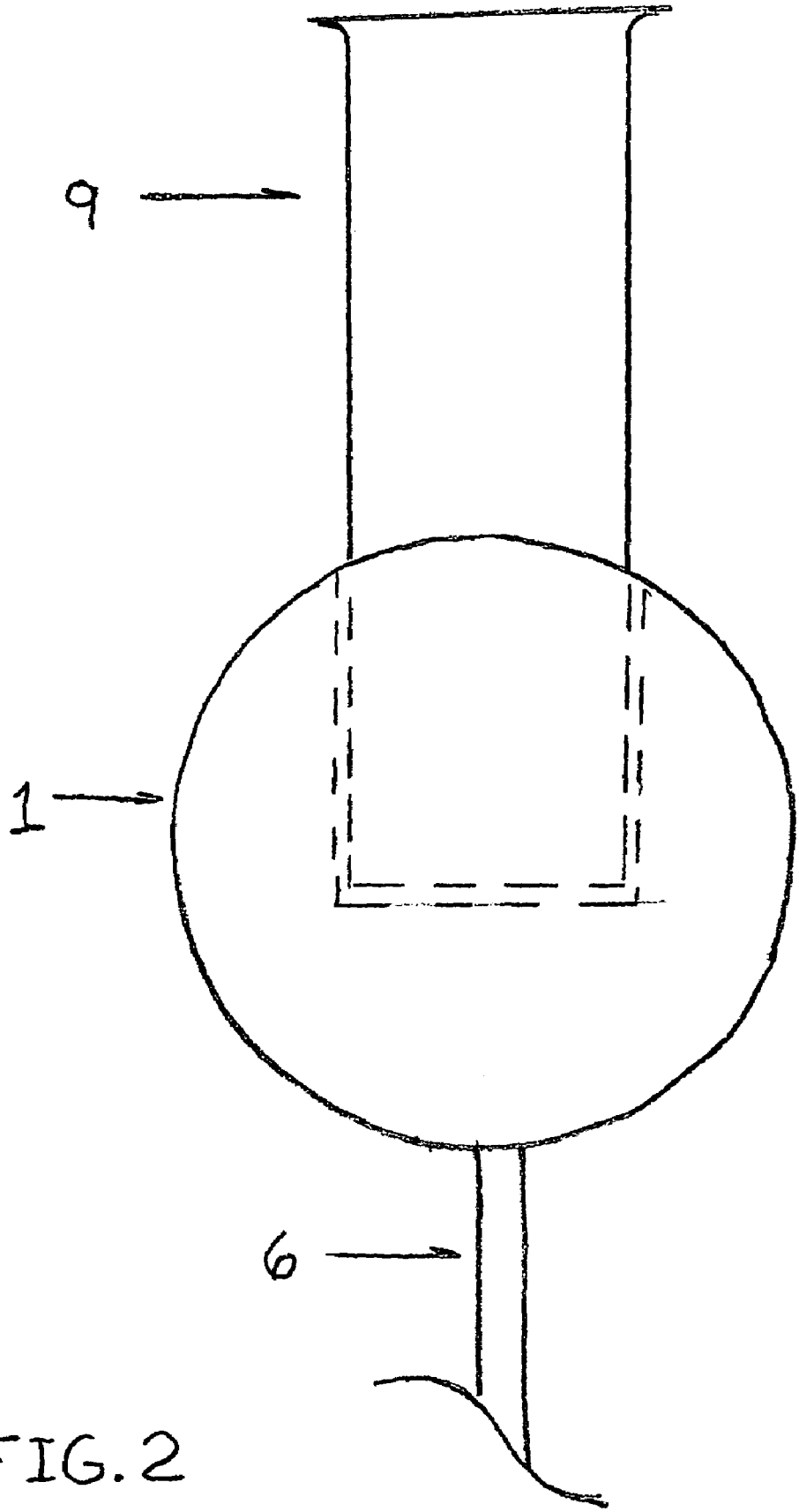
FIG. 2 is a side view of the foam ball with optional fishing pole holding tube installed in the body of the buoy

The foam ball 1 will be manufactured with a ½" diameter wood or plastic 9" long stake 6 tapered at the end 7, formed into the ball during the molding process for the purposes of inserting the ball into sand or other loose dirt ground FIG. 4 12 and allowing the ball FIG. 4 1 to stand up straight and hold the can acting as a beverage holder. Ball diameter and stake length may have alternate sizes. The product when sold to the public may also include FIG. 2 a 3" diameter PVC or plastic pipe 9 with a total length of up to 12" which when inserted into the foam buoy body 1 acts as a fishing pole holder as shown in FIG. 4 1*b*

Figure 3:
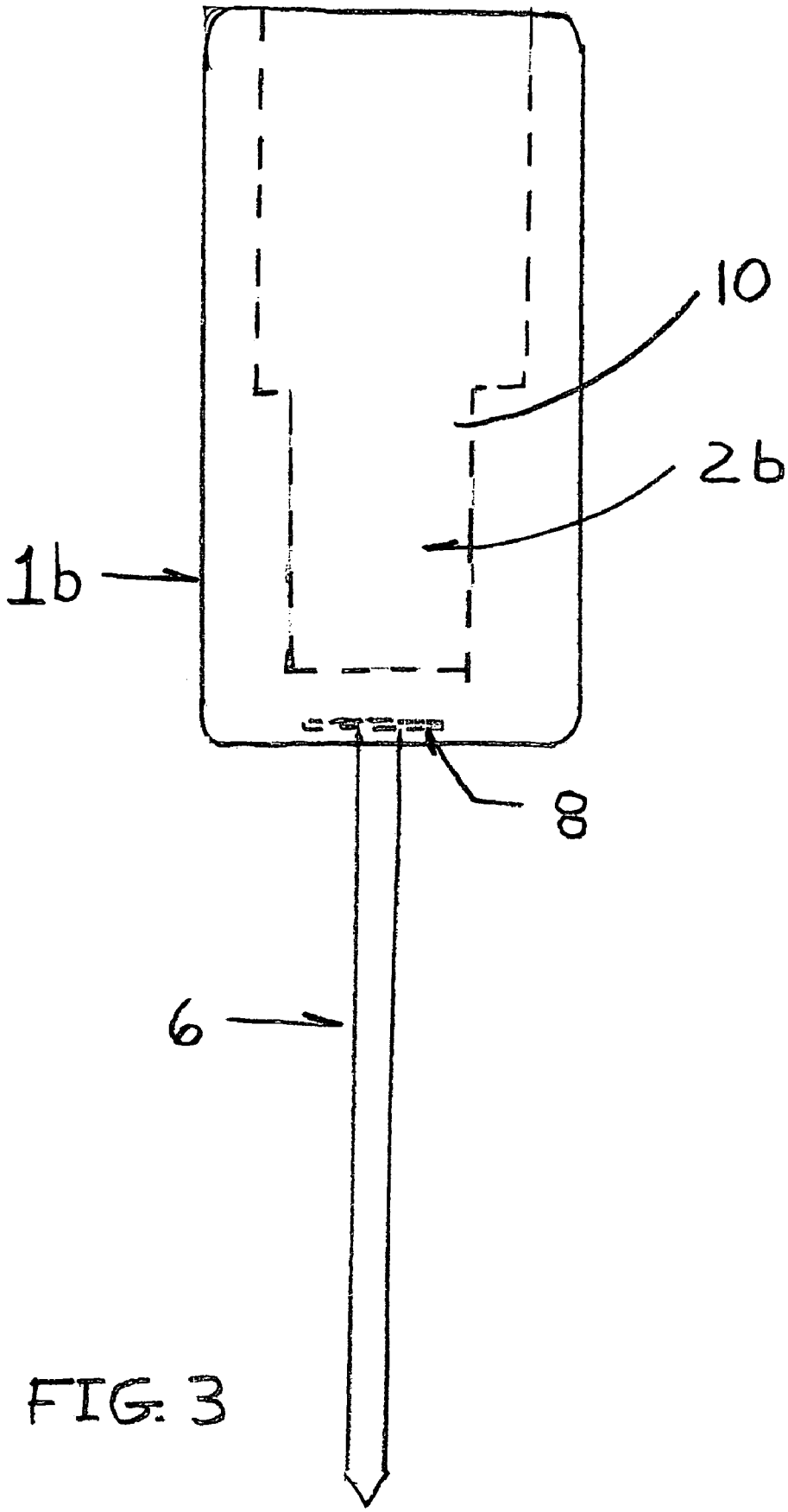
FIG. 3 is a side view of the invention using the cylindrical or square buoy body shape option With tapered hollow core for beverage or fish pole holding

FIG. 3 shows A plastic or wood disk 8 approximately 1 in. In diameter 8 will be attached to the stake by adhesive before the molding process to be molded into the ball 1 base for the purpose of reinforcing the structure of the ball 1 while be pushed into sand or dirt A spring loaded clamp 3 shown in FIG. 1 is designed to clamp onto the beach blanket or papers FIG. 4 for the purpose of holding down such beach blanket 11 or any other materials a person may take to the beach and not want to have them blown away by gusts of wind.

Clamp mechanism 3 is composed of parts including, strong steel spring 5, coorosive resistant body 3, and an upper and lower rubber bushing 4. The spring 5 is attached to the pivoting clamp body by means of a molded cavity in the clamp body 3 securing the upper and lower ends of the spring.

The rubber bushings 4 are molded separately from the clamp body 3 and are installed into the designed holes 4*b* for insertion during assembly. These rubber bushings allow the clamp to slide tightly up and down the stake for height adjustment. Clamp 3 can also be removed from the stake.

DETAILED SPECIFICATION AND DESCRIPTION (Cont.)

Cylindrical and rectangular buoy designs FIG. 3 will be approximately 9" long and 4.5" inches in diameter with the same hollowed out 3" diameter 2*b* for holding the beverage and would not require the PVC fishing pole pipe 9 to hold the fishing pole for holding the pole. The pole would be able to enter into a longer beverage opening and thus hold the fishing rod FIG. 4 10. A taper 10 of approximately 2 inches diameter FIG. 3 inside the body Of the buoy 1*b* will aid to secure the fishing pole 10 inside.

The invention claimed is:

1. A device for anchoring a beach blanket comprising:

a foam body having an open-ended cylindrical hollow, wherein the hollow has a plurality of hollow portions, a first outer-one of the portions having a sufficient diameter to hold a beverage can or bottle, and a second inner-one of the portions having a diameter smaller than that of the first portion;

an elongated stake extending from the foam body and oppositely disposed from the open-ended hollow;

a plastic tube extending from the second inner-one of the portions and out of the foam body, and having a diameter and sufficient length to support a fishing pole when the stake is inserted into the ground; and an alligator clip having arms and at least one aperture in at least one of the arms, wherein the stake passes through the at least one aperture.

2. The device of claim 1, further comprising a rubber bushing in the aperture.

3. The device of claim 1, wherein each of the arms has an aperture therein, wherein the stake passes through each of the apertures.

4. The device of claim 3, further comprising rubber bushings in the apertures.

5. The device of claim 1, wherein the foam body is ball shaped.

6. The device of claim 1, wherein the stake is wood.

7. The device of claim 1, wherein the stake is plastic.

8. The device of claim 1, wherein the tube is removable.

* * * * *